United States Patent [19]

Arnold et al.

[11] Patent Number: 4,463,460

[45] Date of Patent: Aug. 7, 1984

[54] ROMAN TUB FIXTURE

[75] Inventors: Don C. Arnold, Buffalo Grove, Ill.; Thomas J. Wilcox, East Troy, Wis.

[73] Assignee: Indiana Brass, Inc., Frankfort, Ind.

[21] Appl. No.: 407,994

[22] Filed: Aug. 13, 1982

[51] Int. Cl.[3] ..... E03C 1/00

[52] U.S. Cl. ..... 4/191; 137/360; 285/132; 285/298

[58] Field of Search ..... 285/132, 161, 193, 192, 285/298, 64, 31, 56–60, 302, 11, 105, 32; 4/191, 192; 137/360; 403/259, 194, 197, 199, 230, 234

[56] References Cited

U.S. PATENT DOCUMENTS

| | | | |
|---|---|---|---|
| 1,835,301 | 12/1931 | Hennessey | 4/191 |
| 2,233,267 | 2/1941 | McGarry | 137/360 |
| 2,463,405 | 3/1949 | McMaster | 285/64 |
| 2,653,357 | 9/1953 | Sanders et al. | 4/191 |
| 2,896,222 | 7/1959 | Freibott | 4/191 |
| 2,997,058 | 8/1961 | Hall | 137/360 |
| 3,031,212 | 4/1962 | Oliver | 285/31 |
| 3,136,570 | 6/1964 | Lee | 4/192 |
| 3,438,065 | 4/1969 | Morris | 4/191 |
| 3,504,383 | 4/1970 | Young | 4/191 |
| 3,609,774 | 10/1971 | Allgood | 4/191 |
| 3,733,622 | 5/1973 | Searles | 4/191 |
| 3,856,334 | 12/1974 | Lange | 4/192 |
| 3,971,401 | 7/1976 | Persson | 137/360 |
| 4,083,410 | 4/1978 | Anderson | 285/302 |

*Primary Examiner*—Stephen Marcus

*Attorney, Agent, or Firm*—Woodard, Weikart, Emhardt & Naughton

[57] ABSTRACT

A Roman tub fixture assembly for mounting a spout to the exposed spout side of a wall or deck having an exposed spout side and an opposite facing hidden side includes a receiver body which is adapted to couple to one or more water pipes located on the hidden side of the wall or deck. A flanged nut is threadably received over the body in order to mount the body within an opening in walls or decks of different thicknesses. A spout hub having a shank portion and a shoulder portion is threadably received along the shank portion within a passageway in the receiver body. The shank portion includes two cylindrically shaped sections which have different diameters, the larger diameter section having external threads and the smaller diameter section having sealing means in order to seal the space between the body and the hub at a location upstream from the threaded portion of the body passageway. The hub further includes a washer and gasket received over the larger diameter section of the shank portion to firmly secure the shoulder portion to the exposed side of the wall or deck. A spout is received over the shoulder portion of the hub in flow communication with the spout hub and receiver body.

12 Claims, 1 Drawing Figure

ROMAN TUB FIXTURE

BACKGROUND OF THE INVENTION

1. Field of the Invention

The invention relates generally to the field of plumbing fixtures, and more specifically, to an apparatus and method for installing Roman tub fixtures.

2. Description of the Prior Art

Present designs for Roman tubs typically incorporate a large spout which is mounted on the deck alongside the tub or on an adjacent wall. Also, the spout typically has an integral threaded shank which serves both as the incoming waterway as well as the mounting means. While this design may appear to be a reasonable and straightforward design approach, there are some disadvantages. One disadvantage which results from this design is that the connections between the spout and water supply pipes cannot be made until after the surface finishing material is applied to the rough surface of the deck or wall, since for aesthetic reasons the spout rests upon the finished surface. This is a disadvantage because surface finishing is not accomplished until after the deck or wall is closed up, which means installing an access panel in the deck or wall and having to make the connections in a confined area through the typically small access panel. Another disadvantage is that a return trip by the plumber is necessitated after the roughing in plumbing is done in order to make the solder connections between the spout and related water supplies after finishing work on the wall or deck is completed. Further, such spouts have fixed length shafts which do not readily permit wide variance in the roughing in dimensions for the placement of the water supply pipe.

For these reasons, it would be an improvement to provide a fixture assembly for Roman tub spouts which permits the connections between the spout and the related water supply pipes to be made at the same time the valves for the water supply pipes are roughed in. It would be a further improvement to provide a fixture assembly for Roman tub spouts which permits the spout to be easily installed after all the finishing work has been accomplished without the need for a return trip by a plumber in order to install the spout.

The following list of patent references disclose devices which may have some general relevance to the subject invention:

| U.S. Pat. No. | Inventor |
|---|---|
| 1,835,301 | Hennessey |
| 2,653,357 | Sanders |
| 2,896,222 | Freibott |
| 2,233,267 | McGarry |
| 3,438,065 | Morris |
| 3,609,774 | Allgood |
| 3,733,622 | Searles |
| 3,856,334 | Lange |
| 3,971,401 | Persson |

U.S. Pat. No. 3,971,401 to Persson discloses a sillcock mounting arrangement wherein a sleeve is placed in an aperture on one side of the wall and a mating member having a faucet handle thereon is screwed into the sleeve from the opposite side of the wall. This device discloses that the sleeve and the mating member are in telescoping relationship only in order to allow the invention to be installed into different sized walls. However, the Persson device is designed to have the mating member and the sleeve installed at the same time and for this reason does not teach the advantages of using the sleeve as a roughing in device whereby the basic plumbing connections can be made before the rough wall surface has been finished.

U.S. Pat. No. 2,223,267 to McGarry discloses a plural-valve plumbing fixture which is used for roughing in purposes. However, unlike the present invention, the McGarry device requires sweat soldering of the hot and cold connections at the exposed portion of the wall after the finished wall surface is installed.

U.S. Pat. No. 3,609,774 to Allgood and U.S. Pat. No. 3,733,622 to Searles disclose devices providing removable access panels which allow the final fixture connections to be made after roughing in by removing the access panels. Further, U.S. Pat. No. 2,653,357 to Sanders et al. discloses a prefabricated plumbing installation within a finished wall structure. All of these devices require access to be gained behind a wall in order to connect the spout.

U.S. Pat. No. 1,835,301 to Hennessey discloses a plumbing fixture installation which allows the installation of plumbing fixtures in both old and new walls so that the necessary wall apertures may be covered without requiring additional plastering or tile work.

U.S. Pat. No. 3,438,065 to Morris discloses a vandal proof, concealed anchor, plumbing fixture for use with a structural partition having a port therethrough whereby the rigidity of the partition is effectively utilized to prevent unauthorized removal of the fixture by lifting or pulling.

U.S. Pat. No. 2,896,222 to Freibott discloses an adjustable handle and mounting flange construction for shallow valves. An adjustable handle and mounting flange construction is provided which permits the use of a screw-threaded mounting nipple of standard length even though the extent of protrusion of the shallow valve is over a wide range.

U.S. Pat. No. 3,856,334 to Lange discloses an apparatus for attaching a hot and cold water plumbing fixture to building water pipes. A hot and cold water fixture having a pair of water supply lines arranged parallel to each other in the fixture housing is attached to building water pipes by means of a wall fitting which includes a pair of connecting pipes. The parallel end portions of the connecting pipes are of such size and spacing that they may telescope with the supply lines of the plumbing fixture. Sealing means are provided to make watertight the telescope joints between the fixture lines and the connecting pipe to the wall fitting. It is thus possible to mount the fixture against the final wall surface even if the thickness of the wall is changed later. This device is different from the present invention in that it requires separate hot and cold water supply pipes to extend from the exposed portion of the rough wall surface.

None of the above cited references however discloses a device which accomplishes the objects of the present invention. Accordingly it is an object of the present invention to provide a fixture assembly for installing Roman tub spouts which permits the connections between the spout and the related water supply pipes to be made at the same time the valves for the water supply pipes are roughed in.

It is a further object of the present invention to provide a fixture assembly for installing Roman tub spouts which permits the spout to be easily installed after all finishing work has been accomplished without the need for a return trip by a plumber.

Another object of the present invention is to provide a fixture assembly for installation of Roman tub spouts which obviates the need for an access panel.

These and other objects and advantages of the present invention will become more apparent in the following figures and detailed description.

SUMMARY OF THE INVENTION

One embodiment of the present invention includes a receiver body having first and open second ends and a first flow passageway there-between. The first end couples with one or more water pipes located opposite the spout side of a wall or deck so that the body is in flow communication with the one or more water pipes through the first flow passageway. The body also has an attachment means for attaching the body to the hidden side of the wall or deck. A spout hub having a shank portion and a shoulder portion and a second flow passageway therethrough couples at the shank portion of the hub with the second end of the body so that the hub and the body are in flow communication through the first and second flow passageways. A spout is attachable to said shoulder portion of said hub for flow communication with said one or more water pipes.

DESCRIPTION OF THE PREFERRED EMBODIMENT

Figure 1:
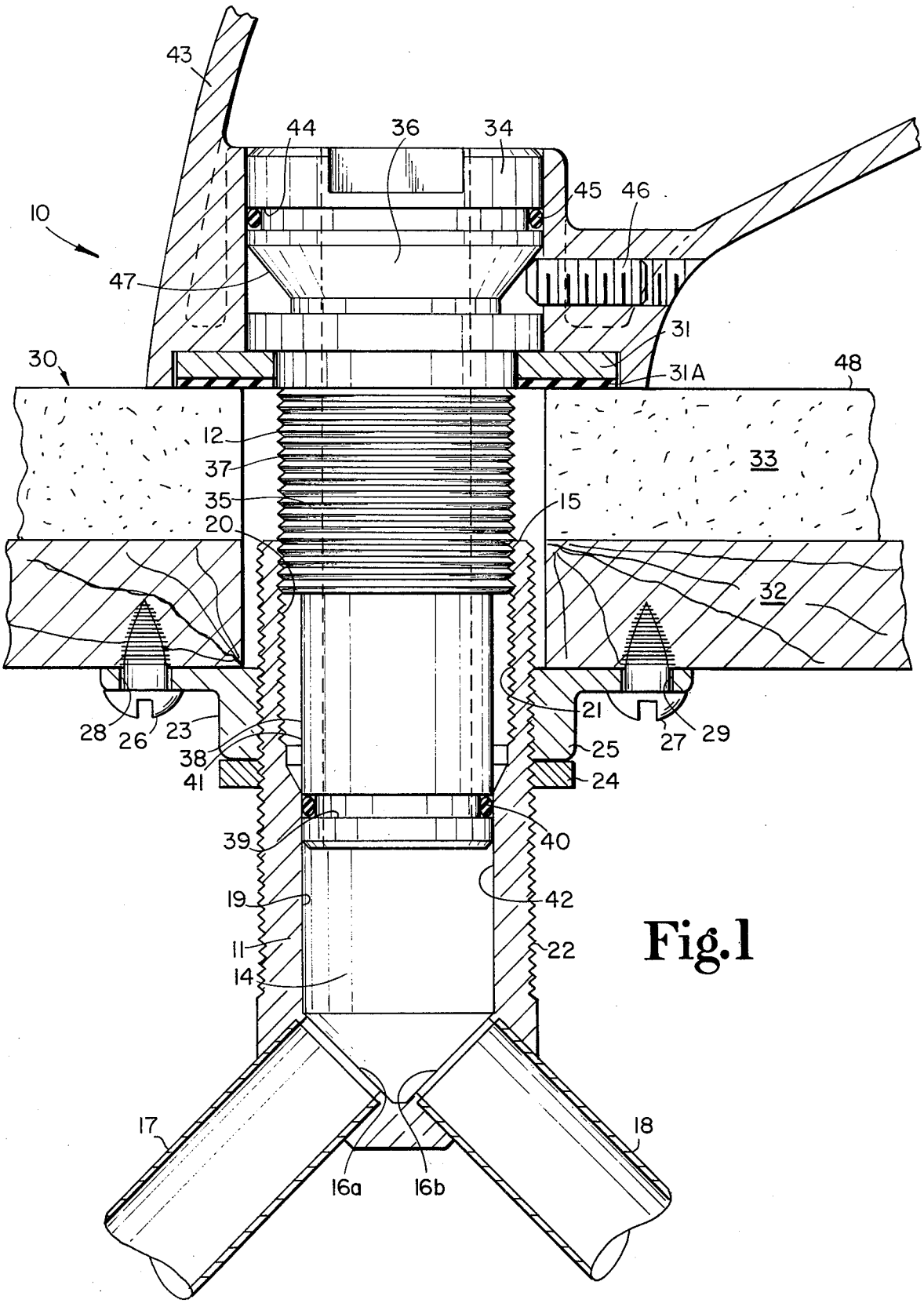
FIG. 1 is a sectional view of the device of the present invention completely assembled and mounted within the deck of a conventional type Roman tub.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawing, FIG. 1 shows Roman tub fixture assembly 10 completely connected and mounted within the deck of a conventional type Roman tub. Exterior portions of assembly 10 have been removed in order to better illustrate the connections between the various elements of the assembly. Alternatively, assembly 10 could be mounted within an adjacent vertical wall given a variant spout design which relates to such an orientation. FIG. 1 shows assembly 10 including receiver body 11 threadably receiving spout hub 12. Receiver body 11 has a generally cylindrical external shape and has a passageway 14 between open end 15 and valve inlet openings **16*a* and 16*b*. Inlet openings 16*a* and 16*b* are shown connected to hot and cold water valve connecting tubes 17 and 18, respectively, which would be "roughed in" just prior to connection of receiver body 11. Passageway 14 includes passageway portions 19 and 20. The diameter of passageway 14 is larger along passageway portion 20 than its corresponding diameter along portion 19. Receiver body 11 has internal threads 21 along passageway portion 20 in order to receive spout hub 12 in a manner which will be more fully described herein. Receiver body 11 has external threads 22 along its outer surface in order to threadably receive attachment means 23 and locknut 24. Attachment means 23 includes flanged nut 25, and screws 26 and 27 which are received through mounting holes 28 and 29 in flanged nut 25**.

FIG. 1 shows spout hub 12 threadably received inside receiver body 11 and secured to the external side of deck 30 by way of washer 31 and gasket 31A. Deck 30 will typically include rough wall thickness or layer 32 and finished wall thickness or layer 33, which will be more fully described hereinafter. Spout hub 12 includes shoulder portion 34 which is shaped to receive thereover a spout, and shank portion 35. Shank portion 35 is shown threadably received in receiver body 11, but is removable therefrom. Spout hub 12 has a flow passageway 36 through the shank and shoulder portions. Thus, when shank portion 35 of spout hub 12 is screwed inside receiver body 11, the spout hub and receiver body are in flow communication through their respective passageways 36 and 14.

Shank portion 35 includes cylindrically shaped shank sections 37 and 38 having different diameters. Shank section 37, which is externally threaded, extends between shoulder portion 34 and shank section 38 and has a larger diameter than shank section 38. Shank section 38 has an annular groove 39 in which a seal ring 40 is disposed. Seal ring 40 may be made of any compressible material suitable for sealing applications, such as rubber. Thus, as shank section 37 is screwed inside passageway portion 20, shank section 38 slides inside passageway portion 19 compressing seal ring 40 and sealing the space between the external surface 41 of shank section 38 and the internal surface 42 of receiver body 11.

It can be seen from FIG. 1 that even if shank section 37 is only screwed a slight distance inside passageway portion 20, shank section 38 will already have progressed far enough inside passageway portion 19 to allow seal ring 40 to effectively seal the space between the internal surface 42 of receiver body 11 and the external surface 41 of section 38. Thus, shank section 37 does not have to be totally received within passageway portion 20 in order to provide a leak proof connection, and variations in total wall thicknesses up to $2\frac{1}{8}''$ can be accommodated between flange nut 25 and the shoulder portion 34 of spout hub 12. Further, shank section 38 serves to add structural rigidity to the connections between spout hub 12 and receiver body 11 by firmly connecting the receiver body and shank portion at a point well inside passageway 14. Also, since the seal will always be upstream from the threaded portions of receiver body 11 and spout hub 12, it is not necessary to seal the connection between the threads. Thus, if removal of the spout hub becomes necessary for any reason after the fixture assembly has been in use, the spout hub will easily unscrew since the threads will not be sealed by a sealing substance.

Spout hub 12 is formed to tightly receive spout 43 over shoulder portion 34. Spout 43 may have any suitable external shape, and for this reason, only the portions of spout 43 which connect to shoulder portion 34 are shown. Shoulder portion 34 has an annular groove 44 and seal ring 45 similar to that found on shank portion 35 for sealing the connection between shoulder portion 34 and spout 43. Spout 43 has a set screw 46 which contacts shoulder portion 34 within tapered annular slot 47 for firmly anchoring spout 43 to shoulder portion 34 and the external surface 48 of finished wall layer 33.

In order to install fixture assembly 10, receiver body 11 is fitted inside a hole within rough wall layer 32 so that open end 15 of receiver body 11 is flush with the surface of rough wall layer 32 upon which finished wall layer 33 is to be applied. Flange nut 25 is then screwed down until it contacts the hidden side of rough wall layer 32. Screws 26 and 27 are then used to firmly mount flange nut 25 to the hidden side of the rough wa. layer. Lock nut 24 is then tightened over flanged nut 25 in order to further secure flanged nut 25 and receiver body 12 to the rough wall layer and prevent flanged nut 25 from rotating. At this same time, the ends of the valve connecting tubes 17 and 18 are soldered to the inlet openings **16*a* and 16*b* of receiver body 11**. Thus, the basic water connections for the spout are made at the same time the corresponding hot and cold valves are roughed in.

After finished wall layer 33 has been added to rough wall layer 32, the remaining portion of the spout fixture assembly 10 can be added without requiring access to the hidden side of the rough wall. To accomplish this attachment, spout hub 12 is secured tightly to receiver body 11 using a wrench.

As stated above, once spout hub 12 is screwed within receiver body 11 to any appreciable distance, shank section 38 will ensure that there is a leakproof connection between receiver body 11 and spout hub 12. The final spout connection is made by slipping spout 43 over the shoulder portion 34 of spout hub 12. Spout 43 is then rotated into proper alignment and secured in place by tightening set screw 46. Since the receiver body 11 is mounted and connected to the valve outlets at the same time the valve outlets are roughed in, the area behind rough wall layer 32 is open, and therefore easily reached. Further, after the finished wall layer 33 has been added, the final installation of assembly 10 is accomplished from the front side of deck 30. Thus, the need for an access panel to make the final connection is no longer necessary. In addition, since installation of spout hub 11 and spout 43 requires no soldering, it would not be necessary for a plumber to make a return trip after the initial roughed in plumbing is accomplished. It should also be noted that installation of spout 43 can be left until all other work is completed, thus protecting the spout from any nicks or scratches from activity by tradesmen as well as from paint spills.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. A Roman tub fixture assembly for flush mounting a spout to walls or decks having a rough wall and a finished wall of variable thicknesses, comprising:

a receiver body having first and second open ends and a first flow passageway therebetween, the first open end adapted for direct coupling with a plurality of spaced apart water pipes in flow communication with the water pipe through the first flow passageway;

means, exclusive of said plurality of water pipes, for mounting said receiver body to the rough wall and preventing axial, lateral and rotational displacement of the receiver body after such mounting, said mounting means providing for adjustment of the axial position of the receiver body relative to the rough wall during mounting;

a spout hub removably coupled to said receiver body, said spout hub having a shank portion and a shoulder portion and a second flow passageway therethrough, the shank portion being telescopically received within the second open end of said receiver body behind the wall or deck such that said spout hub and said receiver body are in flow communication through the first and second flow passageways; and a spout removably coupled to the shoulder portion of said spout hub in flow communication with said water pipes through the first and second flow passageways.

2. The fixture assembly of claim 1, wherein the shank portion of said spout hub has an externally threaded section and the first flow passageway of said receiver body has an internally threaded section configured so that the shank portion of said spout hub may be threadedly received within the second open end of the first flow passageway.

3. The fixture assembly of claim 2, wherein the shank portion of said spout hub further includes a sealing section having a smaller diameter than the externally threaded section, the externally threaded section being located between the sealing section of the shank and the shoulder portion of said spout hub, the first flow passageway of said receiver body further includes a sealing section having an internal diameter larger than the diameter of the sealing section of the shank portion and located adjacent the sealing section of the shank portion, and further including means for sealing between the shank portion of said spout hub and said receiver body when the shank portion is received within said receiver body and for providing a watertight, telescopic coupling.

4. The fixture assembly of claim 3, wherein the sealing section of the shank portion has an annular groove, and the sealing means between the shank portion and said receiver body includes a sealing ring made of a compressible, resilient material disposed within the annular groove of the shank portion so that it seals between the sealing section of the shank portion and the sealing section of the first flow passageway.

5. The fixture assembly of claim 4, wherein said mounting means includes a flanged nut and a lock-nut threadedly received over said receiver body, the flanged nut being moveable between the first and second ends of said receiver body to adjust the position of the second end of said receiver body relative to the outside surface of the rough wall, the lock-nut being threadedly moved against the flanged nut to lock it in the selected position.

6. The fixture assembly of claim 5, wherein the flanged nut includes an annular flange defining a plurality of apertures therethrough and said mounting means further includes a plurality of screws for reception through the apertures to secure the flanged nut to the rough wall.

7. The fixture assembly of claim 1, wherein said spout is rotatable independently of said spout hub about the axis of said spout hub without axial displacement of said spout, and further including means for sealing between the shoulder portion and said spout and for providing a watertight, rotatable coupling.

8. The fixture assembly of claim 7, wherein the shoulder portion has an annular groove, and the sealing means between the shoulder portion and said spout includes a sealing ring made of compressible, resilient material disposed within the annular groove of the shoulder portion so that it seals between the shoulder portion and said spout.

9. A Roman tub fixture assembly for flush mounting a spout to walls or decks having a rough wall and a finished wall of variable thicknesses, comprising:

a receiver body having first and second open ends and a first flow passageway therebetween, the first open end adapted for coupling with one or more water pipes in flow communication with the water pipe through the first flow passageway;

means for mounting said receiver body to the rough wall and preventing axial, lateral and rotational displacement of the receiver body after such mounting, said mounting means providing for adjustment of the axial position of the receiver body relative to the rough wall during mounting, said mounting means including a flanged nut and a lock-nut threadedly received over said receiver body, the flanged nut being moveable between the first and second ends of said receiver body to adjust the position of the second end of said receiver body relative to the outside surface of the rough wall, the lock-nut being threadedly moved against the flanged nut to lock it in the selected position;

a spout hub removably coupled to said receiver body, said spout hub having a shank portion and a shoulder portion and a second flow passageway therethrough, the shank portion being telescopically received within the second open end of said receiver body behind the wall or deck such that said spout hub and said receiver body are in flow communication through the first and second flow passageways; and a spout removably coupled to the shoulder portion of said spout hub in flow communication with the water pipe through the first and second flow passageways.

10. The fixture assembly of claim 9, wherein the shank portion of said spout hub has an externally threaded section and the first flow passageway of said receiver body has an internally threaded section configured so that the shank portion of said spout hub may be threadedly received within the second open end of the first flow passageway.

11. The fixture assembly of claim 10, wherein the shank portion of said spout hub further includes a sealing section having a smaller diameter than the externally threaded section, the externally threaded section being located between the sealing section of the shank and the shoulder portion of said spout hub, the first flow passageway of said receiver body further includes a sealing section having an internal diameter larger than the diameter of the sealing section of the shank portion and located adjacent the sealing section of the shank portion, and further including means for sealing between the shank portion of said spout hub and said receiver body when the shank portion is received within said receiver body and for providing a watertight, telescopic coupling.

12. The fixture assembly of claim 9, wherein said spout is rotatable independently of said spout hub about the axis of said spout hub without axial displacement of said spout, and further including means for sealing between the shoulder portion and said spout and for providing a watertight, rotatable coupling.

* * * * *